US005570477A

United States Patent [19]

Rodriguez

[11] Patent Number: 5,570,477

[45] Date of Patent: Nov. 5, 1996

[54] PORTABLE TOILET BOWL VENTILATOR

[76] Inventor: Victorio C. Rodriguez, 7791 Hoertz Rd., Parma, Ohio 44134

[21] Appl. No.: 490,956

[22] Filed: Jun. 15, 1995

[51] Int. Cl.[6] ..... E03D 9/052

[52] U.S. Cl. ..... 4/213

[58] Field of Search ..... 4/213, 216

[56] References Cited

U.S. PATENT DOCUMENTS

| | | | |
|---|---|---|---|
| 2,846,696 | 8/1958 | Herriott | 4/213 |
| 3,534,415 | 10/1970 | Huffman | 4/213 |
| 4,094,023 | 6/1978 | Smith | 4/213 |
| 4,317,242 | 3/1982 | Stamper | 4/213 |
| 4,375,704 | 3/1983 | Smith | 4/216 X |
| 4,472,841 | 9/1984 | Faulkner | 4/213 |

*Primary Examiner*—Robert M. Fetsuga
*Attorney, Agent, or Firm*—Donald A. Bergquist

[57] ABSTRACT

A portable fan apparatus is provided for ventilating toilet bowls by forced ventilation wherein air from the toilet bowl is exhausted by the fan via a tube that extends through the water trap formed by water in the trap formed partly by the bottom of the toilet bowl and partly by the drain portion of the toilet, thereby exhausting the foul air into the drain line of the building's plumbing system. The apparatus can be carried by a traveler from toilet to toilet, thereby to provide the desired ventilation for any toilet facility the traveler may visit.

10 Claims, 3 Drawing Sheets

PORTABLE TOILET BOWL VENTILATOR

INTRODUCTION

This invention relates to the controlling of offensive odors from a toilet bowl by ventilation. More specifically the ventilation is provided by a battery-powered fan apparatus that vents the odors through a tube that traverses the water trap in the toilet to vent the odors into the sewer vent pipe. Thus the apparatus of this invention may be inserted in any siphon-type toilet, requires no technical installation, and may be removed to be carried to another toilet.

BACKGROUND

Numerous inventors have provided ventilation for a toilet bowl. Such inventions have been incorporated in the body of the toilet bowl, in the seat and lid of the toilet, and as attachments to the rim of the toilet bowl. Many of these prior inventions rely upon an adsorbent medium, such as activated carbon, to remove offensive odors from the air drawn from the toilet bowl. Other of these prior inventions vent the air containing the offensive odors directly outside or through the wall of the room in which the toilet facility is placed. Some of these prior art devices even vent the air containing the offensive odors into the sewer vent pipe (often called the "stack") required by building codes in all sanitary sewer installations.

All of the prior art devices of which applicant is aware require special modifications to the toilet or its environs. Special seats or special lids. Special water tanks or lids therefor. Special toilets having built-in vent lines. Vent holes in walls. All are permanent installations applied to a particular toilet. None has been seen that are transportable for use with more than one toilet.

Thus, it is seen that there is a need for a portable device that is usable in any one of a plurality of toilets and that requires no permanent installation and may easily be inserted into any toilet for use. Such a device could be carried by an individual to be used in any siphon toilet facility the individual may visit.

SUMMARY OF THE INVENTION

Therefore, it is an object of this invention to provide apparatus to ventilate a toilet bowl using forced ventilation in which the exhaust air therefrom is discharged through a tube that traverses the water trap, thereby to exhaust the air into the drain line.

It is a further object of this invention to provide such ventilating apparatus that is portable, so that it can be moved from one toilet to another.

It is another object of this invention to provide such forced ventilation is by means of a fan.

It is another object of this invention to provide such forced ventilation is by means of an electrically-powered fan.

It is another object of this invention to provide such forced ventilation is by means of a battery-powered fan.

DETAILED DESCRIPTION OF THE INVENTION

This invention will be most easily understood by referring to the attached drawings, wherein parts are identified by reference numbers consistent with the following description. In each view, the same part carries the same reference number.

Figure 1:
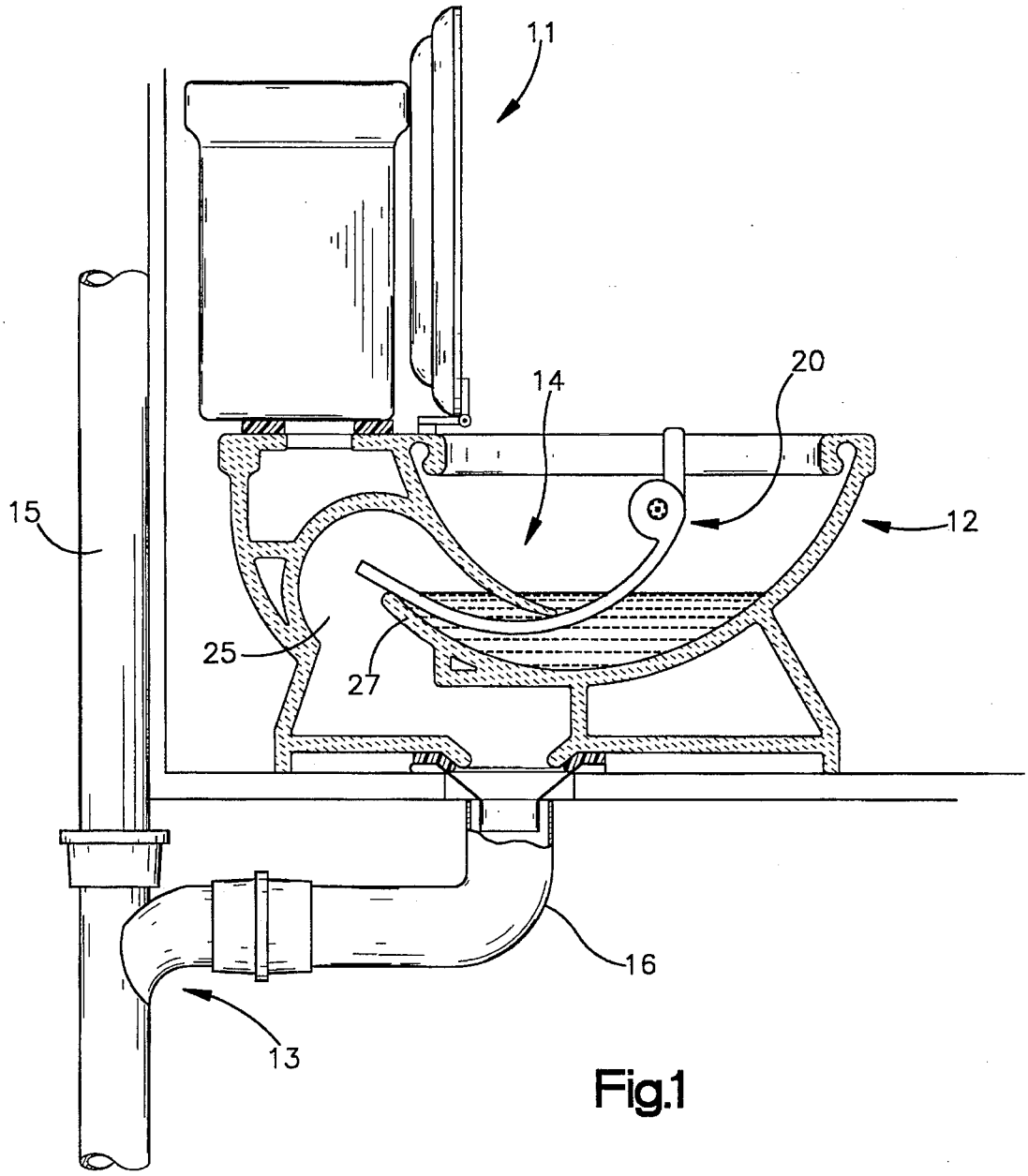
FIG. 1 shows a cross-sectional drawing of a siphon toilet with the invention installed therein.

FIG. 1 illustrates a siphon toilet 11 of the type in common use and shows the present invention 20 installed therein. This type of toilet is often called a flush toilet. The mechanism by which this type of toilet operates is to maintain a level of water in the bottom of the bowl 12 and in an upwardly-directed recurve drain portion 27 of the toilet with which the bowl 12 is in direct communication, thereby forming a barrier to gases in the sanitary drain line 16 that communicates with a sewer or septic tank, which gases could otherwise enter the living quarters where the toilet is installed. In this normal or rest condition, two surfaces are present: one is within a recurve drain portion 27 of the toilet and the other is within the bowl 12 of the toilet. When the bowl 12 is rapidly filled with a quantity of water from a flush tank or flush valve, the water level in the bowl 12 and in the recurve drain portion 27 rises until the level in the drain portion overflows into the drain line 16, whereupon it causes a siphon effect to more rapidly empty the bowl 12 and its contents of waste and water. When the water supplied to the bowl 12 slows, the water level in the bowl drops to a level low enough that air may be drawn into the recurve portion of the drain, thereby to break the siphon effect and allow water to again fill the bowl 12 to substantially the original level, thereby to again form a very effective seal against sewer gases.

It is well known that unpleasant odors in a bathroom can come from the toilet, especially when it is in use. Previous inventors have long recognized the desirability of eliminating these odors where they are most concentrated and before they are dispersed in the room air. Some of these investigators have chosen to vent the malodorous air into the drain lines of the building in which the toilet is installed. Previous investigators, however, did not anticipate the desirability of a traveler carrying equipment with him to the toilet for easy installing and removing. Modern motors and portable power supplies in the form of batteries or safe adapting of household electrical current to bathroom use offer safety and convenience that had not been available in the past. Further, individuals now are more aware of the desirability to not allow foul odors to permeate their homes, even in toilet areas.

The present invention adapts what has been known about odor removal from the toilet bowl and makes it portable and easy to install—or, more correctly, to insert.

It is clear from FIG. 1 that the air space at 25 is in communication via drain line 16 with air in a vent pipe 15, which is open to the atmosphere for venting gases from the drain plumbing 13 in the building in which the plumbing is installed. The invention 20 comprises a fan to force air from the toilet bowl 12 into the air space 25 and thence to the vent pipe 15, thereby to prevent foul odors from the toilet from dispersing into the environs of the toilet.

Figure 2:
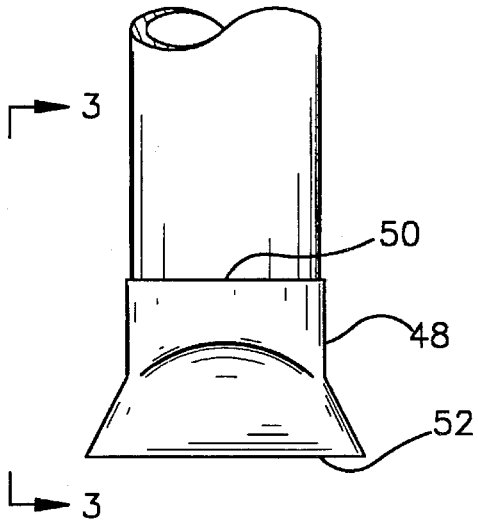
FIG. 2 shows a perspective drawing of the invention with a one-way valve on the outlet thereof.

FIG. 2 shows a detailed view of the invention 20 in one embodiment, comprising: a fan 30 having a fan housing 32 that has an inlet opening 34 and an exhaust opening 36; a flexible tube 40 connected to exhaust opening 36 for carrying the exhaust from fan 30; and a supporting bracket 44 attached to fan housing 32 and adapted to engage the rim of the toilet in a removable manner, thereby to suspend said fan below said rim within said bowl in a removable manner. In use, tube 40 extends through both said water surfaces while fan inlet opening 34 is within bowl 12, thereby to draw by forced convection air from bowl 12 and exhaust that air into the sanitary drain system 13. Clearly, the tube 40 must be flexible enough to be bent within the curvature of the water trap, yet not be so limp as to not be capable of being pushed into the proper position. Many plastic materials are suitable for this tube. Anyone skilled in the art could select a suitable material. The power for the fan shown in FIG. 2 is ultimately electricity from a household receptacle, though the voltage may be reduced through an isolation transformer (not shown) for safety.

Figure 3:
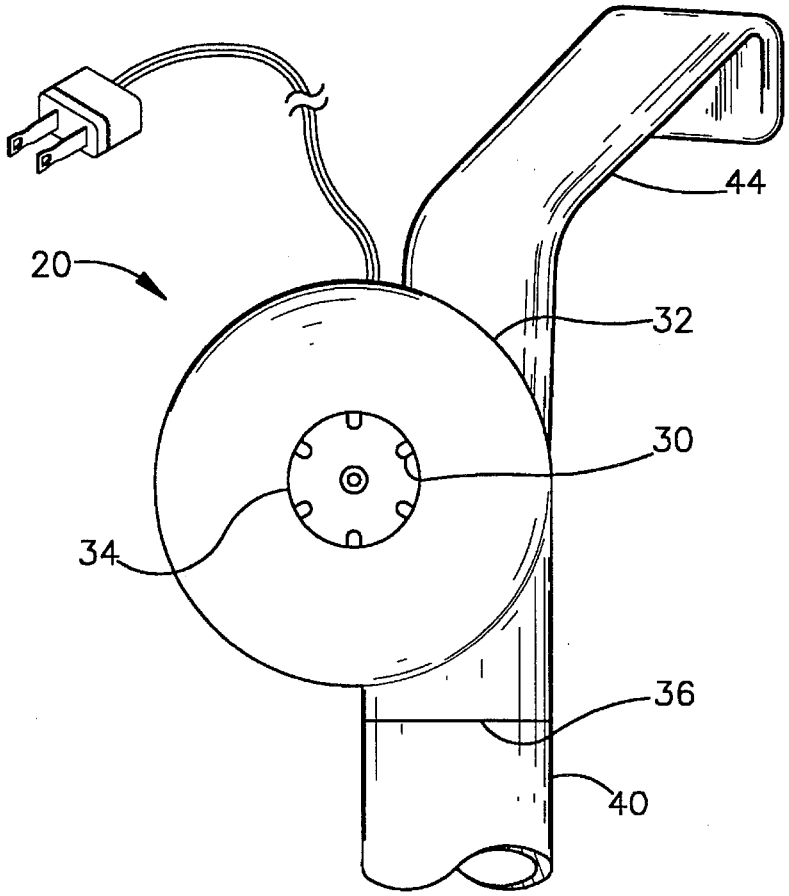
FIG. 3 shows a view the one-way valve as seen along the line 3—3.
Figure 3:
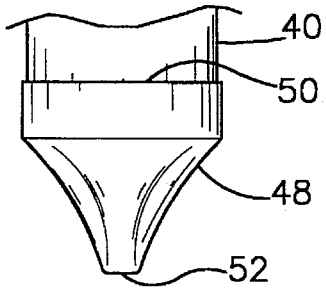

Shown on the end of tube 40 in FIG. 2 is a simple one-way valve 48 that only permits flow out of the tube. This valve keeps water from entering the tube 40 as the tube is inserted into the water in the toilet bowl 12. The valve 48 shown is of a type commonly used to permit condensate to drain from air lines that operate below atmospheric pressure, as in automobile air conditioning equipment. The valve is made of soft plastic or rubber-like material and shaped to fit onto a round tube at its upper end 50 and is flattened at its lower end 52, leaving only a slit as an opening. Any back flow is prevented by closing of the slit caused by reverse pressure that would create such back flow. A side view of valve 48 is shown as FIG. 3.

Figure 4:
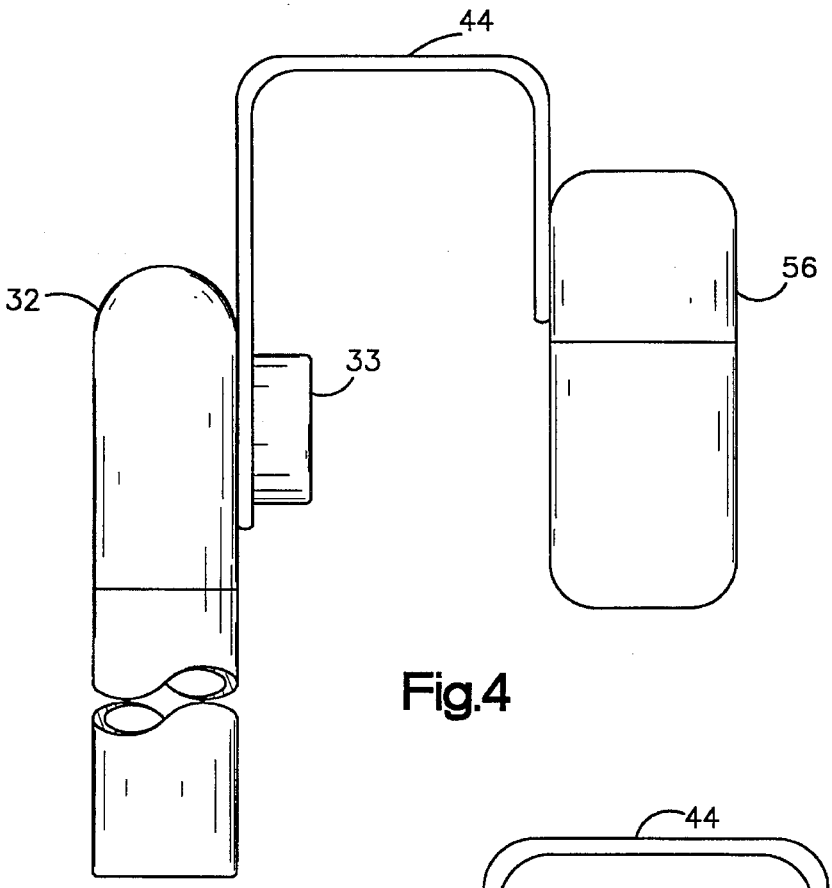
FIG. 4 shows a view of the invention wherein a housing for batteries is suspended outside the toilet bowl.

FIG. 4 shows the invention in another embodiment, including the fan housing 32, a fan motor 33, a bracket 44 adapted to rest on the rim of a toilet bowl, and a housing 56 for a battery suspended outside the bowl 12. Wires to carry electrical energy from the battery within the battery housing 56 and the fan motor 33 are present but not shown.

Figure 5:
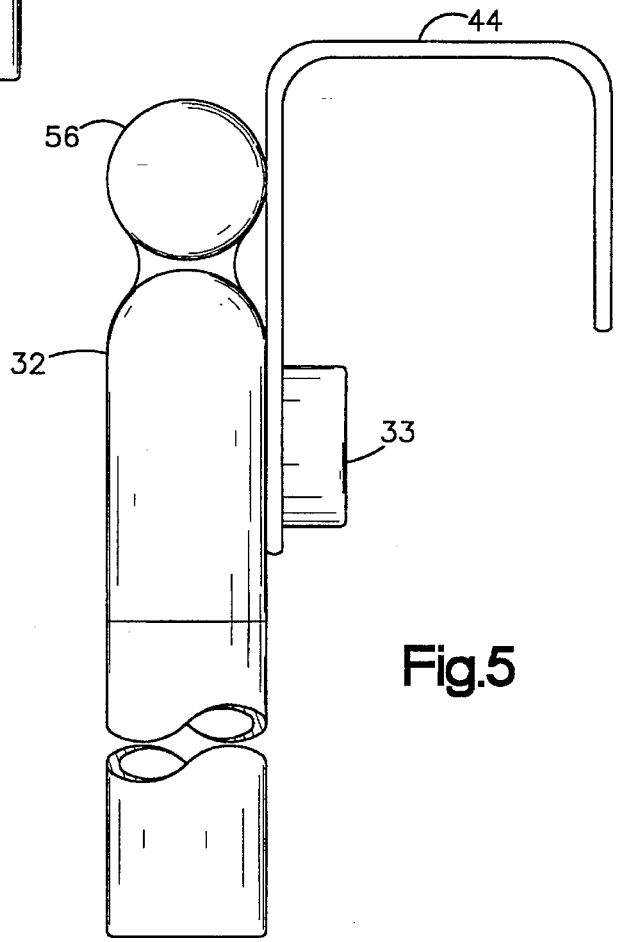
FIG. 5 shows a view of the invention wherein a housing for batteries is suspended inside the toilet bowl.

FIG. 5 shows the invention in yet another embodiment, including the fan housing 32, a fan motor 33, a bracket 44 adapted to rest on the rim of a toilet bowl, and a housing 56 for a battery supported inside the bowl 12. In this example, housing 56 and housing 32 are attached, or contiguous. This need not be the case, as housing 56 and housing 32 are clearly non-contiguous in FIG. 4. Wires to carry electrical energy from the battery within the battery housing 56 and the fan motor 33 are present but not shown.

Having described this invention, including the citing of functional specific examples thereof, applicant desires to include within the scope of his invention those improvements that would be immediately obvious to one skilled in the art, some, but not all of which improvements may have been referred to herein. Applicant desires the breadth of his invention to be limited only by the scope of the claims appended hereto.

I claim:

1. An apparatus for forced ventilation of the bowl of a siphon-type toilet, said toilet bowl comprising a substantially horizontally-oriented rim surrounding a top opening, a concave bowl portion positioned below and contiguous with said rim, an outlet at the lowest point of said bowl, a recurving drain portion adapted to connect said outlet to a sanitary drain, which drain portion curves upward before reaching said sanitary drain, thereby forming with a lower portion of said bowl a trap for water that prevents back flow of gases from said sanitary drain, said water having a first surface totally within said bowl and a separate second surface totally within an upwardly-directed portion of said drain portion, said apparatus for forced ventilation comprising:

(a) a fan having a fan housing that has an inlet opening and an exhaust opening;

(b) a flexible tube connected to said exhaust opening for carrying the exhaust from said fan; and (c) a supporting bracket attached to said fan housing and adapted to engage said rim in a removable manner, thereby to suspend said fan below said rim within said bowl in a removable manner;

whereby, in use, said tube extends through both said water surfaces while said fan inlet opening is within said bowl, thereby to draw by forced convection air from said toilet bowl and exhaust said air into said sanitary drain.

2. The apparatus of claim 1 further said flexible tube is fitted with a one-way valve allowing flow only from said fan.

3. The apparatus of claim 1 wherein said fan is operated by electricity supplied from household wiring.

4. The apparatus of claim 1 wherein said fan is operated by electricity supplied from a battery.

5. The apparatus of claim 4 further comprising a second housing adapted for receiving said battery.

6. The apparatus of claim 5 wherein said second housing is substantially waterproof.

7. The apparatus of claim 5 wherein said second housing and said fan housing are contiguous.

8. The apparatus of claim 5 wherein said second housing and said fan housing are non-contiguous.

9. The apparatus of claim 8 wherein said second housing is suspended by said supporting bracket outside said toilet bowl while said fan housing is suspended by said supporting bracket inside said bowl.

10. An apparatus for forced ventilation of the bowl of a siphon-type toilet, said toilet bowl comprising a substantially horizontally-oriented rim surrounding a top opening, a concave bowl portion positioned below and contiguous with said rim, an outlet at the lowest point of said bowl, a recurving drain portion adapted to connect said outlet to a sanitary drain, which drain portion curves upward before reaching said sanitary drain, thereby forming with a lower portion of said bowl a trap for water that prevents back flow of gases from said sanitary drain, said water having a first surface totally within said bowl and a separate second surface totally within an upwardly-directed portion of said drain portion, said apparatus for forced ventilation comprising:

(a) a battery-powered fan having a fan housing, an inlet opening and an exhaust opening;

(b) a second housing adapted to receive batteries and deliver electricity therefrom to said fan;

(c) a flexible tube having a one-way valve and connected to said exhaust opening for carrying the exhaust from said fan; and (d) a supporting bracket attached to said fan housing and adapted to engage said rim in a removable manner, thereby to suspend said fan below said rim within said bowl and to also suspend said second housing, both suspendings being in a removable manner;

whereby, in use, said tube extends through both said water surfaces while said fan inlet opening is within said bowl, thereby to draw by forced convection air from said toilet bowl and exhaust said air into said sanitary drain.

* * * * *